US009885355B2

(12) United States Patent
Saito et al.

(10) Patent No.: US 9,885,355 B2
(45) Date of Patent: Feb. 6, 2018

(54) PUMP APPARATUS AND MARINE VESSEL PROPELLING MACHINE

(71) Applicant: Showa Corporation, Gyoda-shi (JP)

(72) Inventors: Takahiko Saito, Haga-gun (JP); Atsushi Kagawa, Haga-gun (JP); Hayato Tsutsui, Haga-gun (JP)

(73) Assignee: SHOWA CORPORATION, Gyoda-Shi (JP)

( * ) Notice: Subject to any disclaimer, the term of this patent is extended or adjusted under 35 U.S.C. 154(b) by 165 days.

(21) Appl. No.: 14/866,039

(22) Filed: Sep. 25, 2015

(65) Prior Publication Data

US 2016/0265526 A1 Sep. 15, 2016

(30) Foreign Application Priority Data

Mar. 12, 2015 (JP) ..... 2015-049717

(51) Int. Cl.

| | |
|---|---|
| ***F01C 19/00*** | (2006.01) |
| ***F01C 19/08*** | (2006.01) |
| ***F04C 11/00*** | (2006.01) |
| ***F04C 2/18*** | (2006.01) |
| ***B63H 20/10*** | (2006.01) |
| ***F04C 15/00*** | (2006.01) |

(52) U.S. Cl.

CPC ..... *F04C 11/003* (2013.01); *B63H 20/10* (2013.01); *F01C 19/00* (2013.01); *F01C 19/08* (2013.01); *F04C 2/18* (2013.01); *F04C 11/006* (2013.01); *F04C 15/0046* (2013.01); *F04C 15/0049* (2013.01); *F04C 2270/13* (2013.01)

(58) Field of Classification Search

CPC .. F04C 2/08; F01C 19/00; F01C 19/08; B60T 13/16; F02C 7/00; F02C 7/22; F02C 7/236; F02C 7/32; F02C 9/00; F02C 9/38

USPC ..... 440/61 T; 418/131, 140, 142

See application file for complete search history.

(56) References Cited

U.S. PATENT DOCUMENTS

| | | | | |
|---|---|---|---|---|
| 4,245,964 | A * | 1/1981 | Rannenberg | F02C 7/236 60/734 |
| 5,241,826 | A * | 9/1993 | Stearns | F02C 7/236 60/734 |
| 2012/0018150 | A1* | 1/2012 | Shampine | F04B 23/06 166/250.15 |
| 2012/0141315 | A1* | 6/2012 | Seto | F04C 2/086 418/142 |
| 2012/0242140 | A1* | 9/2012 | Koizumi | B60T 8/4031 418/131 |

FOREIGN PATENT DOCUMENTS

JP 2010-038015 A 2/2010

* cited by examiner

*Primary Examiner* — Lars A Olson

(74) *Attorney, Agent, or Firm* — Leason Ellis LLP

(57) ABSTRACT

A pump apparatus includes a shaft, a first pump, and a second pump. The first pump includes a first driving gear disposed on the shaft in a first phase and rotatable with the shaft to feed a first operating fluid. The second pump includes a second driving gear disposed on the shaft in a second phase shifted from the first phase. The second driving gear is coaxial with the first driving gear and rotatable with the shaft to feed a second operating fluid.

7 Claims, 11 Drawing Sheets

| | Confinement region | Discharge region |
|---|---|---|
| First pump |  |  |
| | R6:Open | R10:Closed |
| Second pump |  |  |
| | R1:Closed | R5:Open |

PUMP APPARATUS AND MARINE VESSEL PROPELLING MACHINE

CROSS-REFERENCE TO RELATED APPLICATIONS

The present application claims priority under 35 U.S.C. §119 to Japanese Patent Application No. 2015-049717, filed Mar. 12, 2015. The contents of this application are incorporated herein by reference in their entirety.

BACKGROUND OF THE INVENTION

Field of the Invention

The present invention relates to a pump apparatus and a marine vessel propelling machine.

Discussion of the Background

Japanese Unexamined Patent Application Publication No. 2010-038015 discloses a pump apparatus that adjusts tilt and trim angles of an outboard engine.

The pump apparatus is a gear pump apparatus and includes a pump case and a pair of pump gears. The pump case defines a shell. The pair of pump gears are inserted in a pump chamber inside the pump case. The pump gears fit with each other turnably on mutually parallel axes.

SUMMARY OF THE INVENTION

According to one aspect of the present invention, a pump apparatus includes a shaft, a first pump, and a second pump. The first pump includes a first driving gear disposed on the shaft in a first phase and rotatable with the shaft to feed a first operating fluid. The second pump includes a second driving gear disposed on the shaft in a second phase shifted from the first phase. The second driving gear is coaxial with the first driving gear and rotatable with the shaft to feed a second operating fluid.

According to another aspect of the present invention, a pump apparatus includes a shaft, a first pump, and a second pump. The first pump includes a first pair of gears. The first pair of gears include a first driving gear and a first driven gear. The first driving gear is disposed on the shaft and rotatable with the shaft, and includes first teeth. The first driven gear is engaged with the first driving gear to be driven by the first driving gear so as to feed a first operating fluid. The first driven gear includes second teeth engageable with the first teeth at a first timing when the shaft rotates. The second pump includes a second pair of gears. The second pair of gears include a second driving gear and a second driven gear. The second driving gear is disposed on the shaft and is coaxial with the first driving gear and rotatable with the shaft, and includes third teeth. The second driven gear is engaged with the second driving gear to be driven by the second driving gear so as to feed a second operating fluid. The second driven gear includes fourth teeth engageable with the third teeth at a second timing different from the first timing when the shaft rotates.

According to the other aspect of the present invention, a vessel propelling machine includes a marine-vessel-propelling-machine body and a tilt-and-trim apparatus. The marine-vessel-propelling-machine body includes a propeller. The tilt-and-trim apparatus includes a cylinder apparatus and a pump apparatus. The cylinder apparatus includes a cylinder, a piston, and a piston rod. The piston partitions an inside of the cylinder into a first chamber and a second chamber. The piston rod has an end fixed to the piston and extends from the cylinder. The pump apparatus is configured to supply an operating fluid into an inside of the cylinder apparatus so as to extend and retract the cylinder apparatus. The pump apparatus includes a shaft, a first pump, a second pump, and a passage. The first pump includes a first pair of gears. The first pair of gears include a first driving gear and a first driven gear. The first driving gear is disposed on the shaft and rotatable with the shaft. The first driven gear is driven by the first driving gear so as to feed a first operating fluid. The second pump includes a second pair of gears. The second pair of gears include a second driving gear and a second driven gear. The second driving gear is disposed on the shaft and coaxial with the first driving gear and rotatable with the shaft. The second driven gear is engaged with the second driving gear to be driven by the second driving gear so as to feed a second operating fluid. The first operating fluid flows into the passage at a first timing, and the second operating fluid flows into the passage at a second timing shifted from the first timing.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE EMBODIMENT

Figure 1:
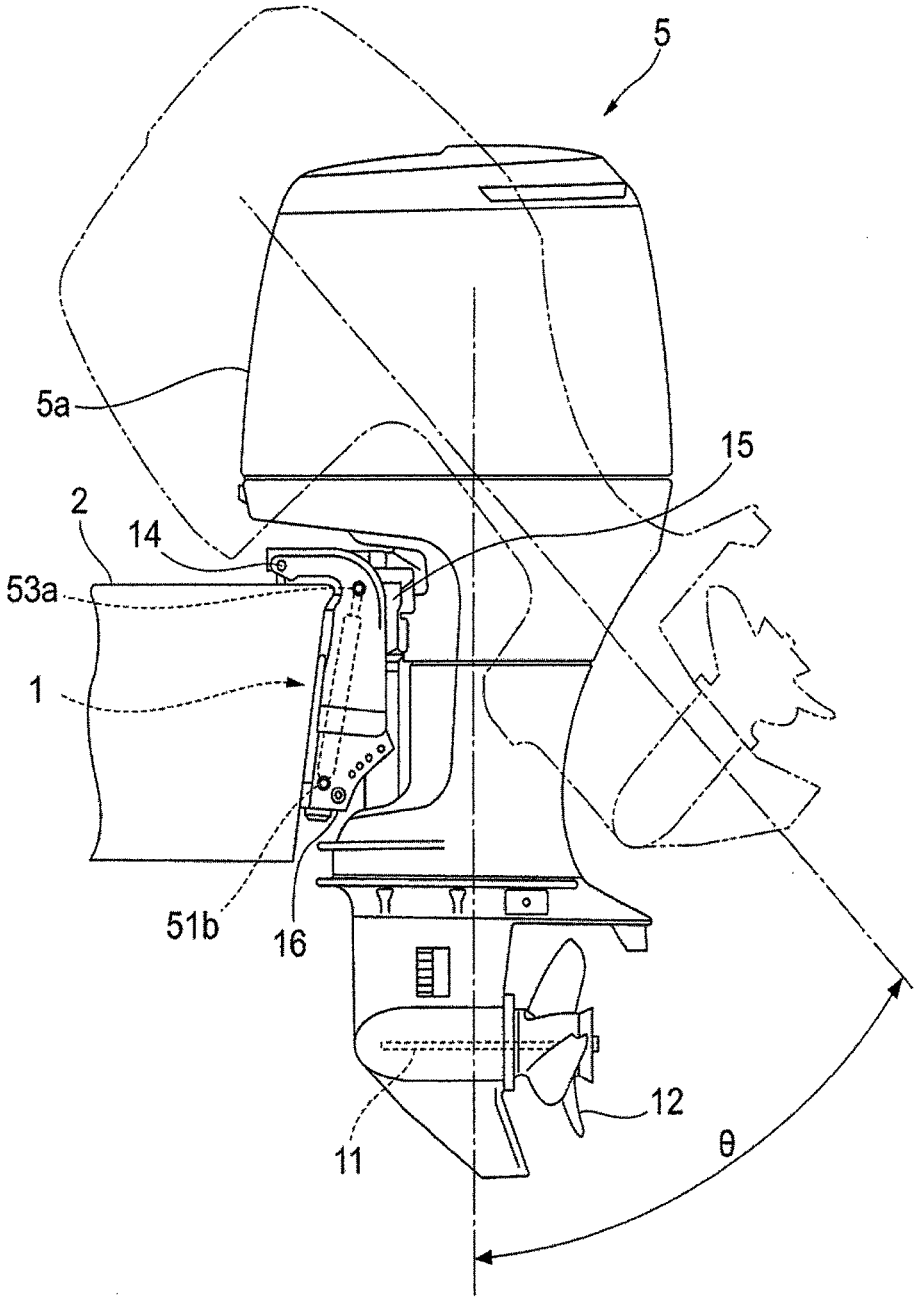
FIG. 1 is a view of a tilt-and-trim apparatus according to an embodiment schematically illustrating a configuration of the tilt-and-trim apparatus.

The embodiments will now be described with reference to the accompanying drawings, wherein like reference numerals designate corresponding or identical elements throughout the various drawings.

FIG. 1 is a view of an outboard engine 5, to which a tilt-and-trim apparatus 1 according to the embodiment is applied.

The outboard engine 5 is an example of the marine vessel propelling machine. The outboard engine 5 includes an engine body 5*a* and the tilt-and-trim apparatus 1. The engine body 5*a* generates a propulsive force to a vessel body 2. The tilt-and-trim apparatus 1 adjusts the inclination angle, θ, of the engine body 5*a* with respect to the vessel body 2.

Schematic Configuration of Engine Body

The engine body 5*a* is an example of the marine-vessel-propelling-machine body. The engine body 5*a* includes an engine and a drive shaft (not illustrated). The engine has its crankshaft (not illustrated) oriented in a direction approximately perpendicular (in the longitudinal direction in FIG. 1) to the water surface. The drive shaft is coupled to a lower end of the crankshaft and thus is rotatable with the crankshaft. The drive shaft extends vertically downward. The engine body 5*a* also includes a propeller shaft 11 and a propeller 12. The propeller shaft 11 is coupled to the drive shaft through a bevel gear mechanism. The propeller 12 mounted on a rear end of the propeller shaft 11.

The engine body 5*a* includes a swivel shaft (not illustrated) and a swivel case 15. The swivel shaft is oriented in a direction approximately perpendicular (in the longitudinal direction in FIG. 1) to the water surface. The horizontal shaft 14 is oriented in a direction approximately parallel to the water surface, and a swivel case 15 in which the swivel shaft is rotatably accommodated. The swivel case 15 is coupled by a pin (not illustrated) to a pin hole 53*a* (not illustrated) of a piston rod 53 of a cylinder apparatus 50, described later, of the tilt-and-trim apparatus 1.

Schematic Configuration of Tilt-and-Trim Apparatus 1

Figure 2:
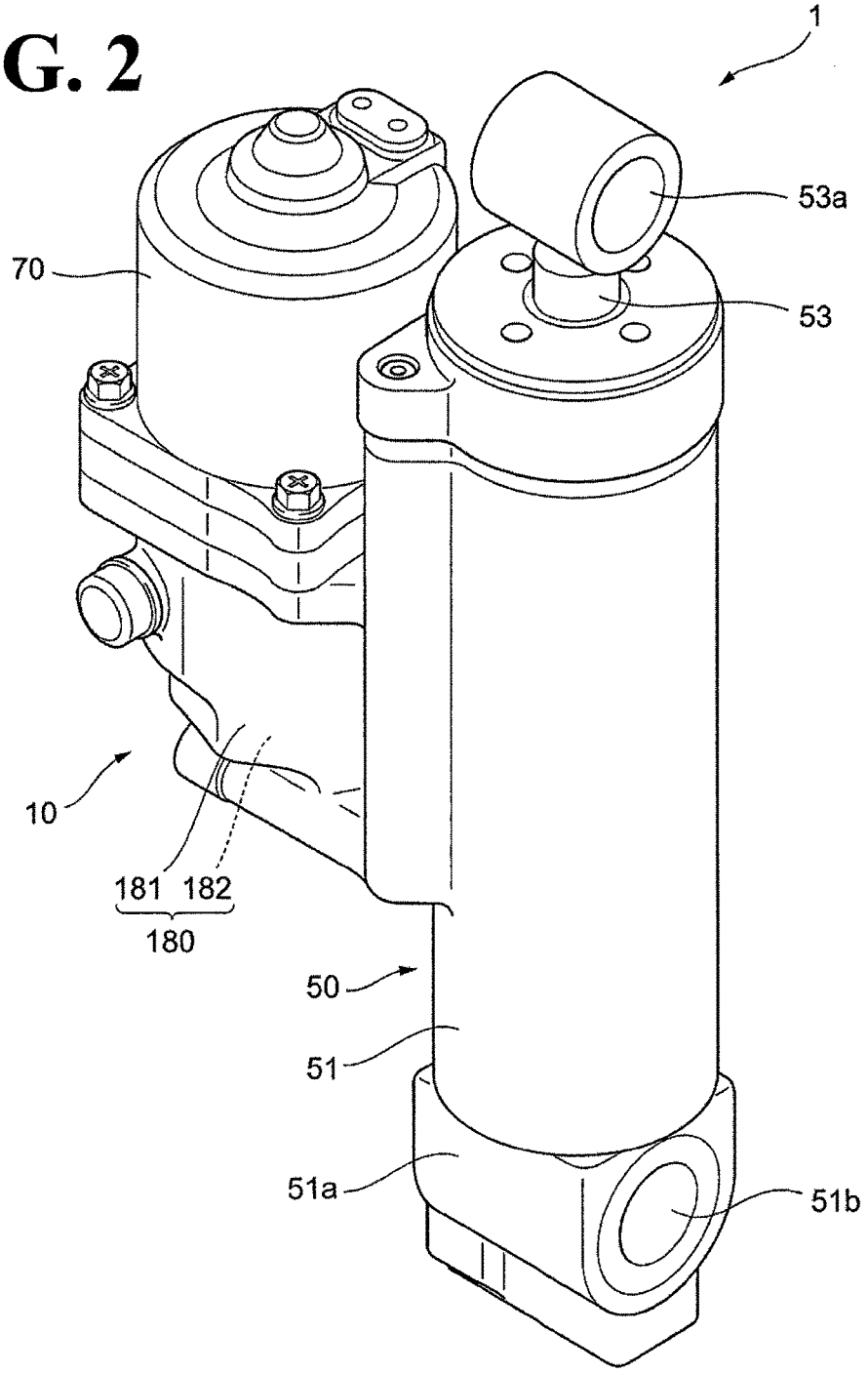
FIG. 2 is an external view of the tilt-and-trim apparatus.

FIG. 2 is an exterior view of the tilt-and-trim apparatus 1.

Figure 3:
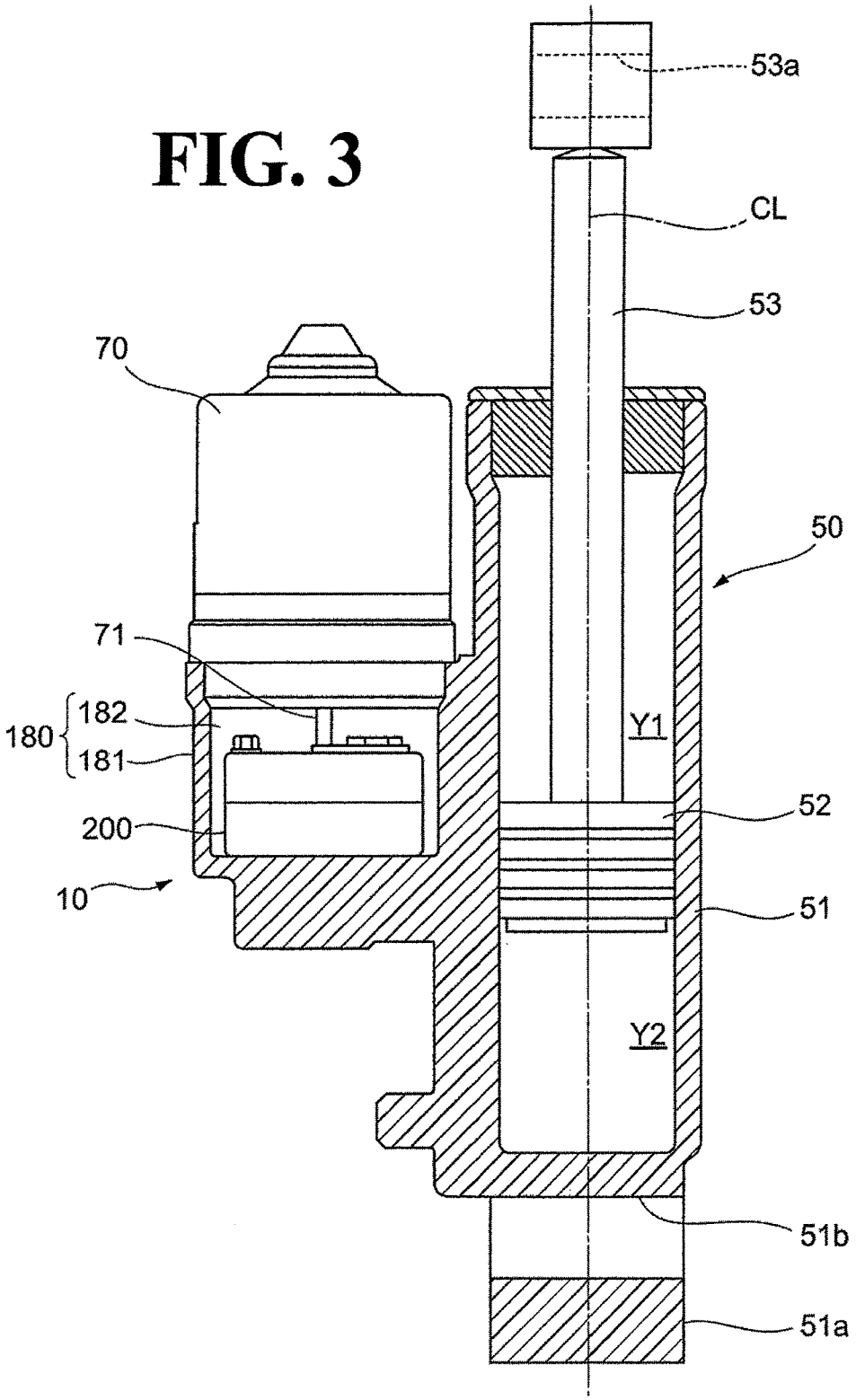
FIG. 3 is a partial sectional view of the tilt-and-trim apparatus.

FIG. 3 is a partial sectional view of the tilt-and-trim apparatus 1.

As illustrated in FIGS. 2 and 3, the tilt-and-trim apparatus 1 includes the cylinder apparatus 50, a pump apparatus 10, and a motor 70. The cylinder apparatus 50 extends and contracts in accordance with oil discharged from and supplied to the cylinder apparatus 50. The pump apparatus 10 discharges the oil. The motor 70 drives the pump apparatus 10.

The tilt-and-trim apparatus 1 includes a stern bracket 16 (see FIG. 1). The stern bracket 16 couples the swivel case 15 of the engine body 5*a* to the vessel body 2. The stern bracket 16 is coupled to a pin hole 51*b* of a cylinder 51, described later, by a pin (not illustrated).

Cylinder Apparatus 50

As illustrated in FIG. 3, the cylinder apparatus 50 includes the cylinder 51 and a piston 52. The cylinder 51 extends in a shaft center direction CL. The piston 52 is disposed inside the cylinder 51 and partitions the internal space of the cylinder 51 into a first chamber Y1 and a second chamber Y2. The cylinder apparatus 50 also includes a piston rod 53. The piston rod 53 holds the piston 52 at one end of the piston rod 53 in the shaft center direction CL, and moves in the shaft center direction CL with respect to the shaft center direction CL together with the piston 52.

In the following description referring to the shaft center direction CL of the cylinder 51, the bottom side of FIG. 3 will occasionally be referred to as "bottom", and the upper side of FIG. 3 will occasionally be referred to as "top".

The cylinder apparatus 50 contracts in accordance with oil supplied to the first chamber Y1, and extends in accordance with oil supplied to the second chamber Y2. When the cylinder apparatus 50 extends, the oil is discharged from the first chamber Y1. When the cylinder apparatus 50 contracts, the oil is discharged from the second chamber Y2.

The cylinder apparatus 50 includes a projection 51*a* on the bottom of the cylinder 51. In the projection 51*a*, a pin hole 51*b* is formed. The pin hole 51*b* receives a pin (not illustrated) that is to be coupled to the stern bracket 16 (see FIG. 1) of the engine body 5*a*. At the top end of the piston rod 53, a pin hole 53*a* is formed. The pin hole 53*a* receives a pin (not illustrated) that is to be coupled to the swivel case 15 (see FIG. 1) of the engine body 5*a*.

The cylinder apparatus 50 extends and contracts with the cylinder apparatus 50 coupled to the stern bracket 16 through the pin hole 51*b*, which is at the bottom of the cylinder 51, and with the cylinder apparatus 50 coupled to the swivel case 15 through the pin hole 53*a* of the piston rod 53, which is at the top end of the piston rod 53. The extension and contraction of the cylinder apparatus 50 change the distance between the stem bracket 16 and the swivel case 15. The change in the distance between the stem bracket 16 and the swivel case 15 changes the inclination angle θ of the engine body 5*a* with respect to the vessel body 2.

Pump Apparatus 10

The pump apparatus 10 includes a tank 180 and a pump 200. The tank 180 stores oil. The pump 200 is disposed in the tank 180 to discharge the oil stored in the tank 180.

Tank 180

As illustrated in FIG. 3, the tank 180 includes a housing 181 and a tank chamber 182. The tank chamber 182 is a space defined by the housing 181 and the motor 70.

In the example illustrated in FIG. 3, the housing 181 has a cylindrical shape that is open at the top of the housing 181 and closed at the bottom of the housing 181. The housing 181 is integral to the cylinder 51 of the cylinder apparatus 50. Between the cylinder 51 and the housing 181, holes (not illustrated) are formed. The holes define a first passage 111 and a second passage 112.

As illustrated in FIG. 3, the motor 70 is secured to the top of the housing 181 to keep the top opening of the housing 181 liquid tight. In the motor 70, its driving shaft 71 is coupled to the pump 200, which is disposed in the tank chamber 182. The driving shaft 71 is rotationally driven to rotationally drive the pump 200.

Figure 4:
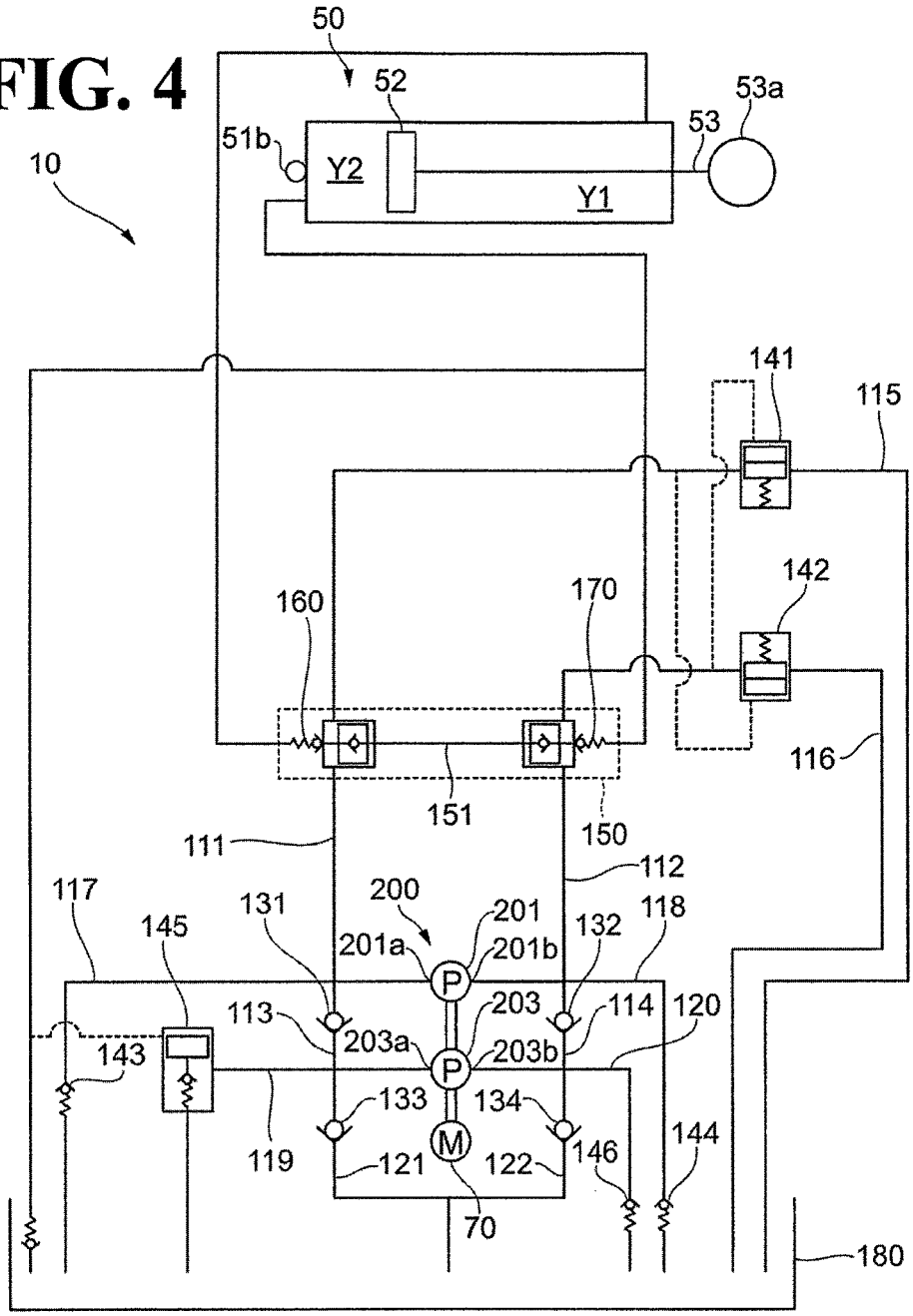
FIG. 4 is a circuit diagram illustrating a hydraulic circuit of the pump apparatus.

FIG. 4 is a hydraulic circuit of the pump apparatus 10.

Pump 200

As illustrated in FIG. 4, the pump 200 includes a first pump 201 and a second pump 203. The first pump 201 includes a first discharge outlet 201*a* and a second discharge outlet 201*b*. The first discharge outlet 201*a* and the second discharge outlet 201*b* each discharge the oil stored in the tank 180. The second pump 203 includes a third discharge outlet 203*a* and a fourth discharge outlet 203*b*.

In the pump 200, normal rotation of the motor 70 causes the first discharge outlet 201*a* of the first pump 201 and the third discharge outlet 203*a* of the second pump 203 to discharge the oil. Also in the pump 200, reverse rotation of the motor 70 causes the second discharge outlet 201*b* of the first pump 201 and the fourth discharge outlet 203*b* of the second pump 203 to discharge the oil.

Passage of Pump Apparatus 10 and Valve Arrangement

As illustrated in FIG. 4, the pump apparatus 10 includes a first passage 111 and a second passage 112. The first passage 111 couples the first chamber Y1 of the cylinder apparatus 50 and the first discharge outlet 201*a* of the first pump 201 to each other. The second passage 112 couples the second chamber Y2 of the cylinder apparatus 50 and the second discharge outlet 201*b* of the first pump 201 to each other.

The pump apparatus 10 also includes a third passage 113 and a fourth passage 114. The third passage 113 couples the first chamber Y1 of the cylinder apparatus 50 and the third discharge outlet 203*a* of the second pump 203 to each other. The fourth passage 114 couples the second chamber Y2 of the cylinder apparatus 50 and the fourth discharge outlet 203*b* of the second pump 203 to each other.

In the example illustrated in FIG. 4, the third passage 113 is coupled to the first chamber Y1 of the cylinder apparatus 50 through the first passage 111, and the fourth passage 114 is coupled to the second chamber Y2 of the cylinder apparatus 50 through the second passage 112.

In the third passage 113, the pump apparatus 10 includes a first check valve 131. The first check valve 131 allows the oil to flow from the third discharge outlet 203*a* of the second pump 203 to the first passage 111, and prevents the oil from flowing from the first passage 111 to the third discharge outlet 203*a*.

In the fourth passage 114, the pump apparatus 10 includes a second check valve 132. The second check valve 132 allows the oil to flow from the fourth discharge outlet 203*b* of the second pump 203 to the second passage 112, and prevents the oil from flowing from the second passage 112 to the fourth discharge outlet 203*b*.

The pump apparatus 10 includes a first intake passage 121. The first intake passage 121 couples the third passage 113 and the tank 180 to each other, and feeds the oil stored in the tank 180 to the third discharge outlet 203*a*.

The pump apparatus 10 includes a second intake passage 122. The second intake passage 122 couples the fourth passage 114 and the tank 180 to each other, and feeds the oil stored in the tank 180 to the fourth discharge outlet 203*b*.

In the first intake passage 121, the pump apparatus 10 includes a third check valve 133. The third check valve 133 allows the oil to flow from the tank 180 to the third discharge outlet 203*a*, and prevents the oil from flowing from the third discharge outlet 203*a* to the tank 180.

In the second intake passage 122, the pump apparatus 10 includes a fourth check valve 134. The fourth check valve 134 allows the oil to flow from the tank 180 to the fourth discharge outlet 203*b* of the second pump 203, and prevents the oil from flowing from the fourth discharge outlet 203*b* to the tank 180.

The pump apparatus 10 includes a fifth passage 115 and a fifth passage switch valve 141. The fifth passage 115 branches off from the first passage 111 and is coupled to the tank 180. The fifth passage switch valve 141 is disposed in the fifth passage 115 and receives pressure from a sixth passage 116 (described below) to open the fifth passage 115.

The pump apparatus 10 includes the sixth passage 116 and a sixth passage switch valve 142. The sixth passage 116 branches off from the second passage 112 and is coupled to the tank 180. The sixth passage switch valve 142 receives pressure from the fifth passage 115 to open the sixth passage 116.

The pump apparatus 10 includes a seventh passage 117 and an eighth passage 118. The seventh passage 117 branches off from the first passage 111 and is coupled to the tank 180. The eighth passage 118 branches off from the second passage 112 and is coupled to the tank 180.

The pump apparatus 10 includes a seventh passage switch valve 143 in the seventh passage 117. When the pressure of oil in the seventh passage 117 is higher than a seventh predetermined value of pressure, the seventh passage switch valve 143 is opened to release the oil in the first passage 111 into the tank 180 through the seventh passage 117.

The pump apparatus 10 includes an eighth passage switch valve 144. The eighth passage switch valve 144 is disposed in the eighth passage 118. When the pressure of oil in the eighth passage 118 is higher than an eighth predetermined value of pressure, the eighth passage switch valve 144 is opened to release the oil in the second passage 112 into the tank 180 through the eighth passage 118.

The pump apparatus 10 includes a ninth passage 119 and a ninth passage switch valve 145. The ninth passage 119 branches off from the third passage 113 and is coupled to the tank 180. The ninth passage switch valve 145 is disposed in the ninth passage 119 and receives the pressure of the second passage 112 to open the ninth passage 119.

The pump apparatus 10 includes a tenth passage 120 and a tenth passage switch valve 146. The tenth passage 120 branches off from the fourth passage 114 and is coupled to the tank 180. The tenth passage switch valve 146 is disposed in the tenth passage 120. When the pressure of oil in the tenth passage 120 is higher than a tenth predetermined value of pressure, the tenth passage switch valve 146 is opened to release the oil in the tenth passage 120 into the tank 180.

The pump apparatus 10 includes a switch valve 150. The switch valve 150 is coupled to the first passage 111 and the second passage 112, and switches between discharge and return of oil.

The switch valve 150 includes a first switch valve 160 and a second switch valve 170. The first switch valve 160 is disposed in the first passage 111. The second switch valve 170 is disposed in the second passage 112.

In the switch valve 150, a communication passage 151 is formed. The communication passage 151 communicates the first switch valve 160 and the second switch valve 170 with each other.

Pump 200

Figure 5:
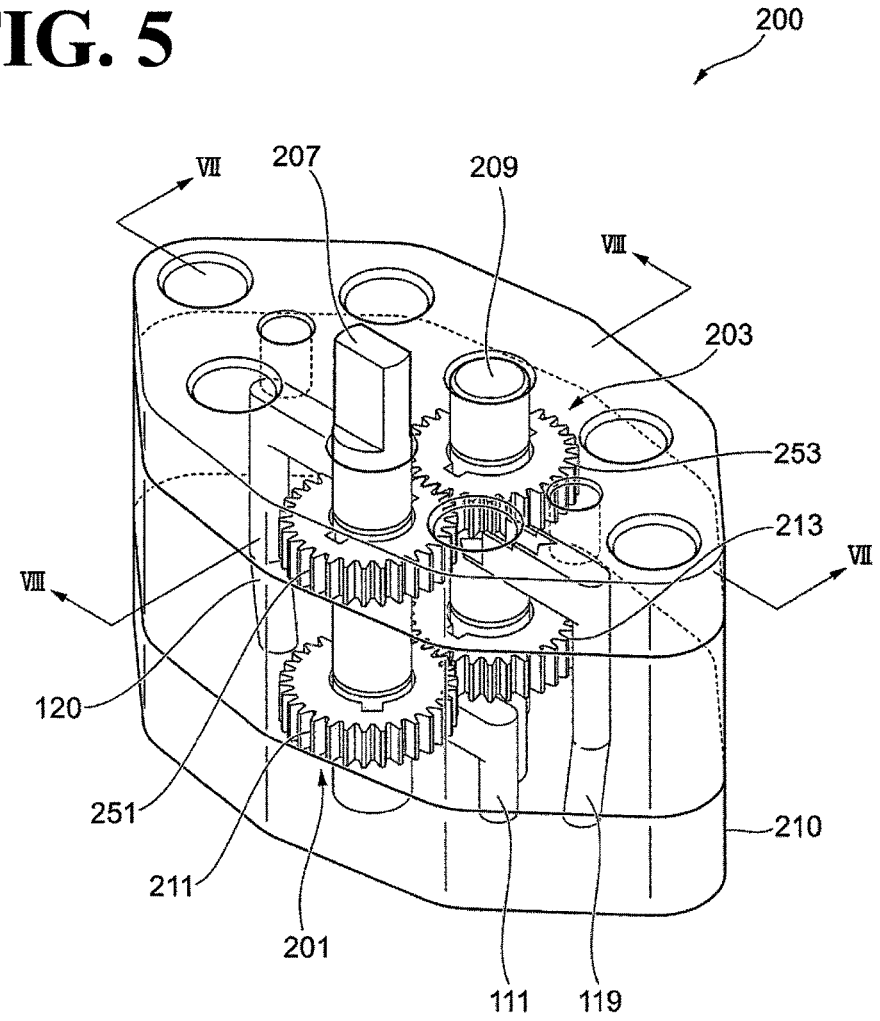
FIG. 5 is a perspective external view of a pump.

FIG. 5 is an exterior view of the pump 200.

Figure 6:
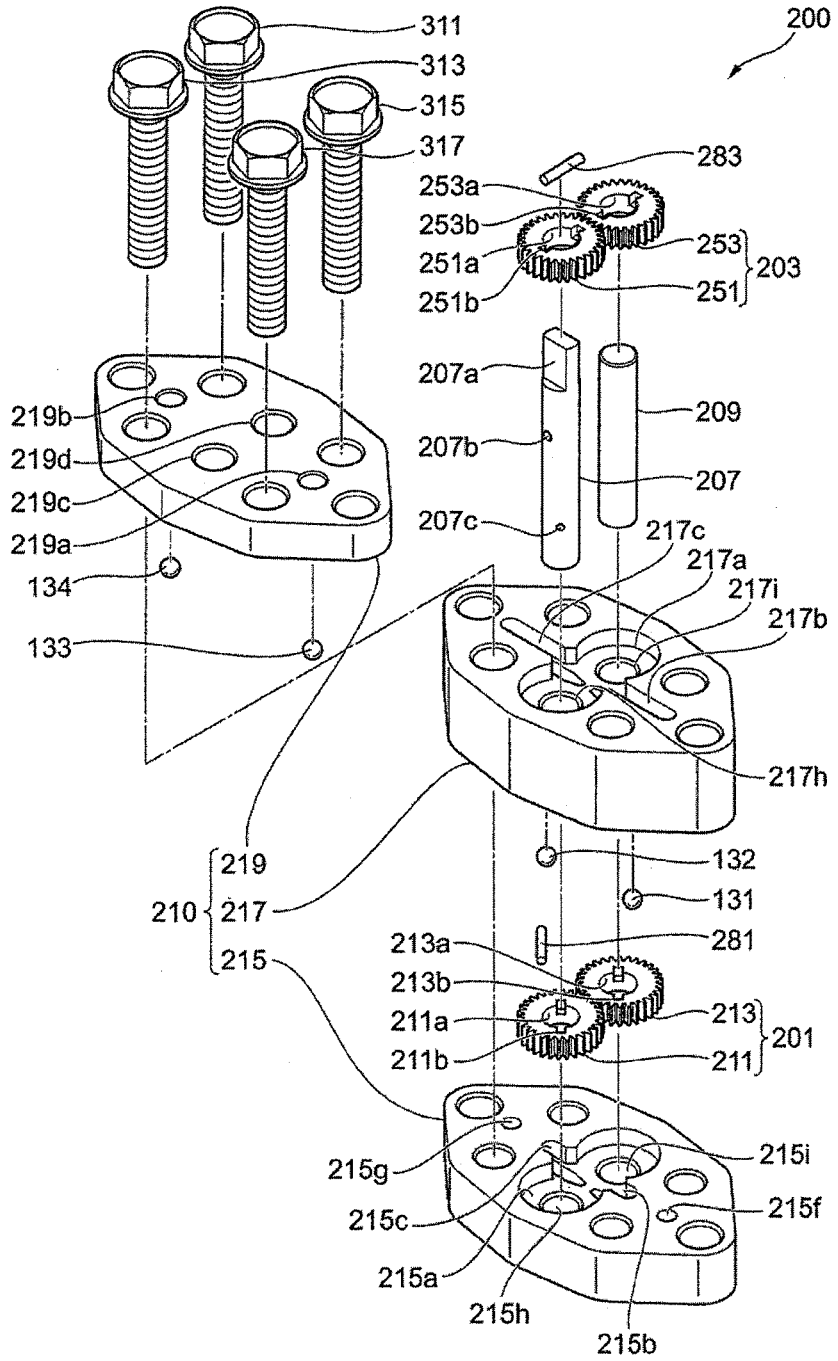
FIG. 6 is a perspective exploded view of the pump.

FIG. 6 is an exploded perspective view of the pump 200.

As illustrated in FIG. 5, the pump 200 includes a pump casing 210, a first pump 201, and a second pump 203. The first pump 201 includes a first driving gear 211 and a first driven gear 213. The second pump 203 includes a second driving gear 251 and a second driven gear 253.

The pump 200 also includes a driving shaft 207 and a support pin 209. The driving shaft 207 drives the first driving gear 211 and the second driving gear 251. The support pin 209 supports the first driven gear 213 and the second driven gear 253.

The pump 200 also includes a first fixing member 281 (illustrated in FIG. 6), a second fixing member 283 (illustrated in FIG. 6), and the first to fourth check valves 131 to 134 (illustrated in FIG. 6). The first fixing member 281 and the second fixing member 283 respectively fix the first driving gear 211 and the second driving gear 251 to the driving shaft 207.

Pump Casing 210

Figure 7:
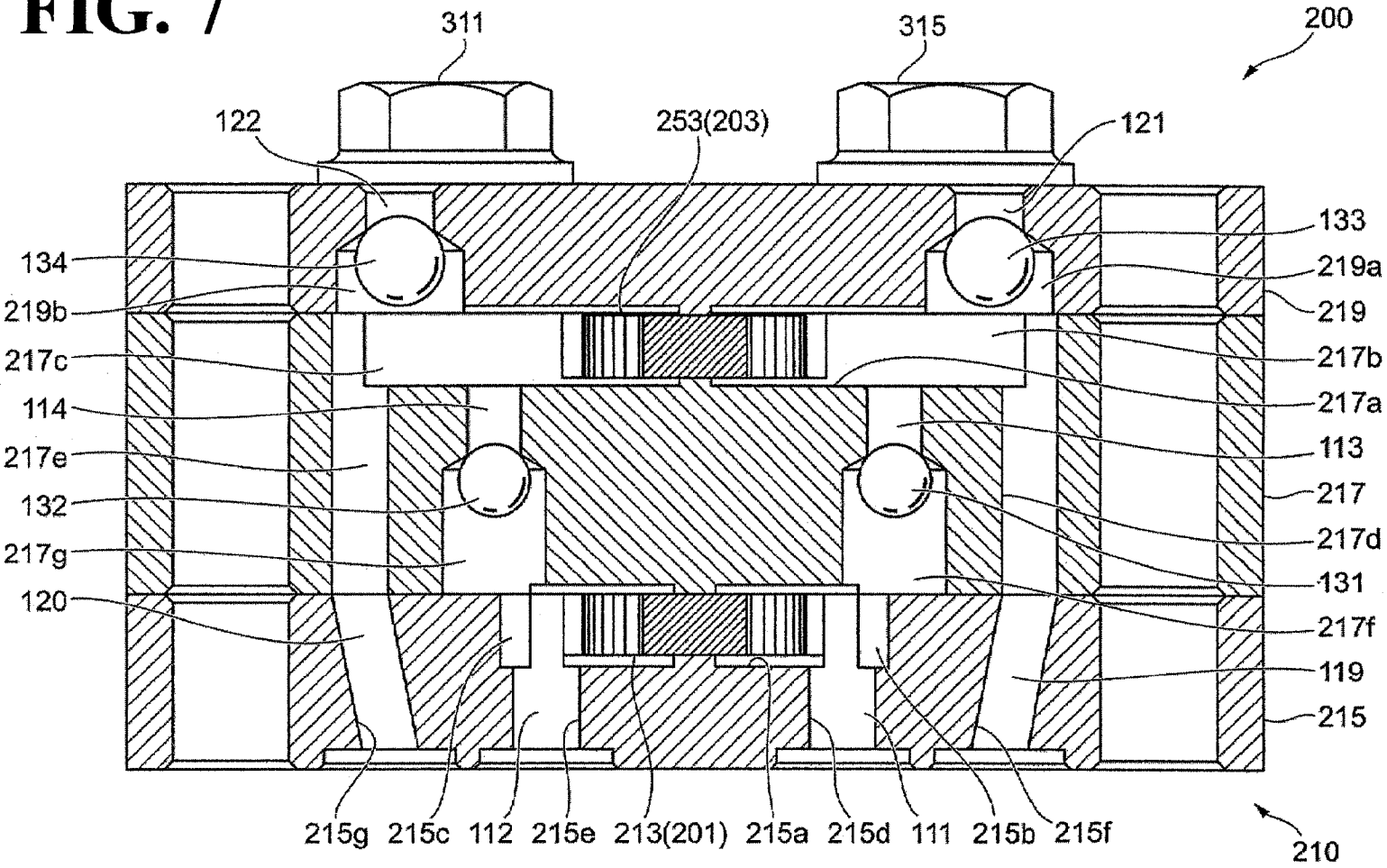
FIG. 7 is a cross-sectional view of the section taken along the line VII-VII of FIG. 5.

FIG. 7 is a cross-sectional view of the section taken along the line VII-VII of FIG. 5.

Next, a pump casing 210 will be described below by referring to FIGS. 6 and 7.

As illustrated in FIG. 6, the pump casing 210 has what is called a "three-layer structure" in which a first casing 215, a second casing 217, and a third casing 219 are stacked atop each other in this order from bottom to top in FIG. 6. The pump casing 210 is fixed to the housing 181 (see FIG. 2) by a bolt (not illustrated).

In the first casing 215, a first pump chamber 215*a*, a first groove 215*b*, and a second groove 215*c* are formed. The first pump chamber 215*a* accommodates the first pump 201. The first groove 215*b* communicates with the first pump chamber 215*a*. The second groove 215*c* communicates with the first pump chamber 215*a* on the opposite side of the first groove 215*b*. As illustrated in FIG. 7, the first groove 215*b* is included in the first passage 111, and the second groove 215*c* is included in the second passage 112.

As illustrated in FIG. 7, also in the first casing 215, a first through hole 215*d*, a second through hole 215*e*, a third through hole 215*f*, and a fourth through hole 215*g* are formed. The first through hole 215*d* is included in the first passage 111. The second through hole 215*e* is included in the second passage 112. The third through hole 215*f* is included in the ninth passage 119. The fourth through hole 215*g* is included in the tenth passage 120. The first to fourth through holes 215*d* to 215*g* penetrate the first casing 215 in its thickness direction.

As illustrated in FIG. 6, also in the first casing 215, a first support hole 215*h* and a second support hole 215*i* are formed. The first support hole 215*h* receives the driving shaft 207. The second support hole 215*i* receives the support pin 209. The first support hole 215*h* and the second support hole 215*i* penetrate the first casing 215 in its thickness direction.

In the second casing 217, a second pump chamber 217*a*, a third groove 217*b*, and a fourth groove 217*c* are formed. The second pump chamber 217*a* accommodates the second pump 203. The third groove 217*b* communicates with the second pump chamber 217*a*. The fourth groove 217*c* communicates with the second pump chamber 217*a* on the opposite side of the third groove 217*b*. As illustrated in FIG. 7, the third groove 217*b* is included in the ninth passage 119, and the fourth groove 217*c* is included in the tenth passage 120.

As illustrated in FIG. 7, also in the second casing 217, a fifth through hole 217*d*, a sixth through hole 217*e*, a first check valve chamber 217*f*, and a second check valve chamber 217*g* are formed. The fifth through hole 217*d* is included in the ninth passage 119. The sixth through hole 217*e* is included in the tenth passage 120. The first check valve chamber 217*f* is included in the third passage 113 and accommodates the first check valve 131. The second check valve chamber 217*g* is included in the fourth passage 114 and accommodates the second check valve 132. The fifth through hole 217*d*, the sixth through hole 217*e*, the first check value chamber 217*f*, and the second check valve chamber 217*g* penetrate the second casing 217 in its thickness direction.

As illustrated in FIG. 6, also in the second casing 217, a third support hole 217*h* and a fourth support hole 217*i* are formed. The third support hole 217*h* receives the driving shaft 207. The fourth support hole 217*i* receives the support pin 209. The third support hole 217*h* and the fourth support hole 217*i* penetrate the second casing 217 in its thickness direction.

As illustrated in FIG. 7, in the third casing 219, a third check valve chamber 219*a* and a fourth check valve chamber 219*b* are formed. The third check valve chamber 219*a* is included in the first intake passage 121 and accommodates the third check valve 133. The fourth check valve chamber 219*b* is included in the second intake passage 122 and accommodates the fourth check valve 134. The third check valve chamber 219*a* and the fourth check valve chamber 219*b* penetrate the third casing 219 in its thickness direction.

As illustrated in FIG. 6, also in the third casing 219, a fifth support hole 219*c* and a sixth support hole 219*d* are formed. The fifth support hole 219*c* receives the driving shaft 207. The sixth support hole 219*d* receives the support pin 209. The fifth support hole 219*c* and the sixth support hole 219*d* penetrate the third casing 219 in its thickness direction.

First Pump 201 and Second Pump 203

Next, the first pump 201 and the second pump 203 will be described below by referring to FIG. 6.

As described above, the first pump 201 includes the first driving gear 211 and the first driven gear 213. The second pump 203 includes the second driving gear 251 and the second driven gear 253.

The first driving gear 211, the first driven gear 213, the second driving gear 251, and the second driven gear 253 have identical shapes. That is, a common gear structure can be used in the first driving gear 211, the first driven gear 213, the second driving gear 251, and the second driven gear 253. The first driving gear 211 and the first driven gear 213 form a first pair of gears, and the second driving gear 251 and the second driven gear 253 form a second pair of gears.

Specifically, the first driving gear 211 has the through hole 211*a*, and the second driving gear 251 has the through hole 251*a*. The through hole 211*a* and the through hole 251*a* receive the driving shaft 207. A fixing groove 211*b* is formed on one surface of the first driving gear 211, and a fixing groove 251*b* is formed on one surface of the second driving gear 251. The fixing groove 211*b* and the fixing groove 251*b* extend radially. In the example illustrated in FIG. 6, the fixing grooves 211*b* and 251*b* radially extend respectively across the through holes 211*a* and 251*a*.

The first driven gear 213 has a through hole 213*a*, and the second driven gear 253 has a through hole 253*a*. The through hole 213*a* and the through hole 253*a* receive the support pin 209. A fixing groove 213*b* is formed on one surface of the first driven gear 213, and a fixing groove 253*b* is formed on one surface of the second driven gear 253. In the example illustrated in FIG. 6, the fixing grooves 211*b* and 253*b* radially extend respectively across the through holes 213*a* and 253*a*.

The first driving gear 211, the first driven gear 213, the second driving gear 251, and the second driven gear 253 have equal numbers of teeth and have identical tooth shapes. The first driving gear 211, the first driven gear 213, the second driving gear 251, and the second driven gear 253 are each made of a material such as metal or resin highly resistant to abrasion. A non-limiting example is a sintered metal.

Driving Shaft 207

Next, the driving shaft 207 will be described below by referring to FIG. 6.

The driving shaft 207, which is an example of the shaft, is an approximately cylindrical member. In the driving shaft 207, a flat surface 207*a* and shaft holes 207*b* and 207*c* are formed. The flat surface 207*a* is formed on the outer surface of the driving shaft 207 at its one axial end, and is coupled to the motor 70 (see FIG. 2). The shaft holes 207*b* and 207*c* radially penetrate the driving shaft 207.

The driving shaft 207 through the pump casing 210 has a length that extends over the first casing 215, the second casing 217, and the third casing 219 with the flat surface 207*a* protruding from the pump casing 210. The driving shaft 207 has an outer diameter that allows the driving shaft 207 to be inserted into the through hole 211*a* of the first driving gear 211 and the through hole 251*a* of the second driving gear 251.

The shaft holes 207*b* and 207*c* are formed at different positions in the axial direction of the driving shaft 207. The shaft holes 207*b* and 207*c* differ from each other in orientation. Specifically, the shaft holes 207*b* and 207*c* have different angles (mounting angles) with respect to the central axis of the driving shaft 207 on a surface orthogonal to the central axis of the driving shaft 207. In the example illustrated in FIG. 6, the shaft holes 207*b* and 207*c* differ from each other by 45 degrees.

Support Pin 209

Next, the support pin 209 will be described below by referring to FIG. 6.

The support pin 209 is an approximately cylindrical member.

The support pin 209 through the pump casing 210 has a length that extends over the first casing 215, the second casing 217, and the third casing 219. In the example illustrated in FIG. 6, the support pin 209 through the pump casing 210 has a length that keeps the support pin 209 within the pump casing 210.

The support pin 209 has an outer diameter that allows the support pin 209 to be inserted into the through hole 213*a* of the first driven gear 213 and the through hole 253*a* of the second driven gear 253. In the example illustrated in FIG. 6, the outer diameter of the support pin 209 is less than the outer diameter of the driving shaft 207.

As illustrated in FIG. 6, the support pin 209 is different from the driving shaft 207 in that no shaft holes 207*b* or 207*c* are formed.

First Fixing Member 281 and Second Fixing Member 283

Next, the first fixing member 281 and the second fixing member 283 will be described below by referring to FIG. 6.

The first fixing member 281 and the second fixing member 283 are elongate members. In the example illustrated in FIG. 6, the first fixing member 281 and the second fixing member 283 have approximately cylindrical shapes. The first fixing member 281 and the second fixing member 283 each are dimensioned to be insertable respectively into the shaft holes 207*b* and 207*c* of the driving shaft 207. The first fixing member 281 and the second fixing member 283 each are also dimensioned to make the opposite ends of each of the members 281 and 283 protrude beyond the driving shaft 207 when the members 281 and 283 are respectively inserted through the shaft holes 207*b* and 207*c*, and make the opposite ends of each of the members 281 and 283 respectively engaged in the fixing grooves 211*b* and 251*b*.

Arrangement and Movement of Components

Figure 8:
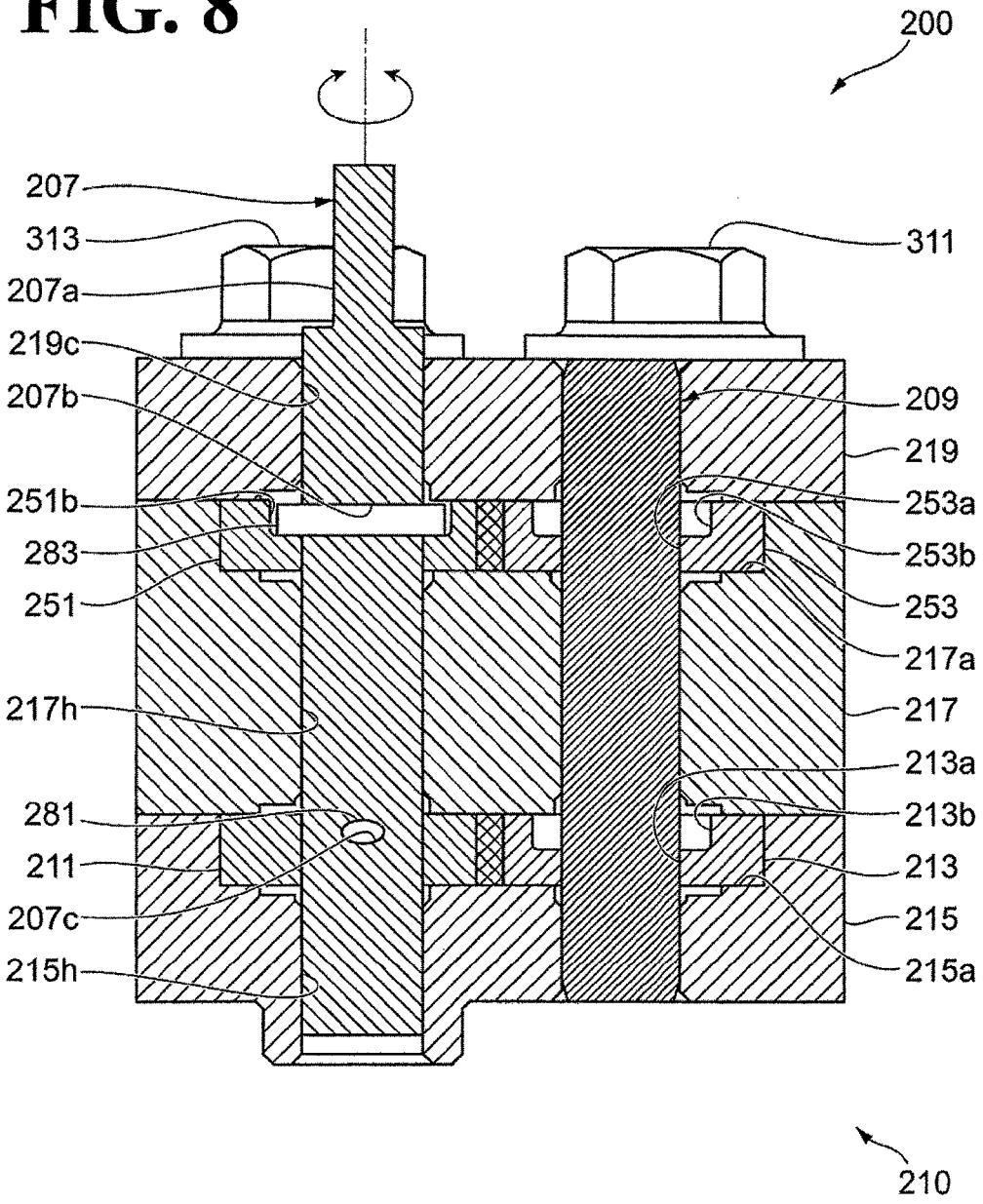
FIG. 8 is a cross-sectional view of the section taken along the line VIII-VIII of FIG. 5.

FIG. 8 is a cross-sectional view of the section taken along the line VIII-VIII of FIG. 5.

Next, by referring to FIGS. 6 to 8, description will be made with regard to how the components of the assembly of the pump 200 are arranged and move.

First, description will be made with regard to how the driving shaft 207 is arranged and moves.

The driving shaft 207 penetrates the pump casing 210. The driving shaft 207 is rotatably supported by the first casing 215, the second casing 217, and the third casing 219. The flat surface 207*a* of the driving shaft 207 protrudes from the first casing 215 and is coupled to the motor 70 (see FIG. 2).

The driving shaft 207 penetrates the first driving gear 211 and the second driving gear 251. That is, the first driving gear 211 and the second driving gear 251 are coaxial gears.

The first fixing member 281 and the second fixing member 283 are disposed through the shaft holes 207*b* and 207*c* of the driving shaft 207. The first fixing member 281 and the second fixing member 283, which are respectively inserted into the shaft holes 207*b* and 207*c*, protrude from the outer surface of the driving shaft 207, and are respectively disposed in the fixing groove 211*b* of the first driving gear 211 and the fixing groove 251*b* of the second driving gear 251. The first fixing member 281 and the second fixing member 283 prevent a shift in relative positions of the first driving gear 211, the second driving gear 251, and the driving shaft 207.

This arrangement ensures that when the driving shaft 207 rotates in response to the driving of the motor 70, the first driving gear 211 and the second driving gear 251 rotate together with the driving shaft 207.

Next, description will be made with regard to how the support pin 209 is arranged and moves.

The support pin 209 penetrates the pump casing 210. The support pin 209 is fixed by the first casing 215, the second casing 217, and the third casing 219. That is, the support pin 209 is supported by the pump casing 210, and is restricted in making circumferential and axial movements. Specifically, the support pin 209 is engaged with the first casing 215, the second casing 217, and the third casing 219. More specifically, the support pin 209 is inserted under pressure in the first casing 215, the second casing 217, and the third casing 219.

The support pin 209 penetrates the first driven gear 213 and the second driven gear 253. That is, the first driven gear 213 and the second driven gear 253 are coaxial gears. The first driven gear 213 and the second driven gear 253 are rotatable around the outer circumference of the support pin 209. The first driven gear 213 and the second driven gear 253 are respectively engaged with the first driving gear 211 and the second driving gear 251.

The arrangement described hereinbefore ensures that in response to the rotation of the motor 70, the first driving gear 211 and the second driving gear 251 rotate to cause the first driven gear 213 and the second driven gear 253 to rotate around the outer circumference of the support pin 209. Here, the first driven gear 213 and the second driven gear 253 are different from the driving shaft 207 in that the first driven gear 213 and the second driven gear 253 rotate around the outer circumference of the fixed support pin 209, instead of rotating together with the support pin 209.

As described above, the fixing grooves 213*b* and 253*b* are respectively formed in the first driven gear 213 and the second driven gear 253. The fixing grooves 213*b* and 253*b* function as oil storages when oil enters the fixing grooves 213*b* and 253*b*.

Specifically, in the first driven gear 213, oil enters the fixing groove 213*b* and then enters the space between the inner surface of the through hole 213*a* of the first driven gear 213 and the outer surface of the support pin 209. In the second driven gear 253, the oil in the fixing groove 253*b* enters the space between the inner surface of the through hole 253*a* of the second driven gear 253 and the outer surface of the support pin 209. This configuration improves slidability in each of the first driven gear 213 and the second driven gear 253 when the gears 213 and 253 rotate around the outer surface of the support pin 209.

As described above, the support pin 209 is engaged with the first casing 215, the second casing 217, and the third casing 219. That is, the support pin 209 determines the position of the support pin 209 in relation to each of the first casing 215, the second casing 217, and the third casing 219.

Thus, in the assembling work of the pump 200, the support pin 209 is usable as a positioning member. A non-limiting example is to engage the support pin 209 with the first casing 215, and combine the second casing 217, the third casing 219, and other components with the support pin 209. This configuration eliminates or minimizes a shift in the relative positions of the first casing 215, the second casing 217, and the third casing 219.

In the example illustrated in FIG. 6, the fastening members 311, 313, 315, and 317 function to fasten the first casing 215, the second casing 217, and the third casing 219.

This embodiment will be further described in comparison with a configuration different from this embodiment.

In the different configuration, the support pin 209 rotates together with the first driven gear 213 and the second driven gear 253. In this case, the support pin 209 is rotatably supported by the first casing 215, the second casing 217, and the third casing 219.

This necessitates a reduction in the contact pressure applied to the support pin 209 in order to prevent seizure of the support pin 209. In order to reduce the contact pressure, it is necessary to employ a configuration that increases the dimensions of the pump 200. Examples of such configuration include a configuration in which the support pin 209 has an increased axial length at the portion of the support pin 209 supported by the first casing 215, and a configuration with an additional bearing to receive the support pin 209.

In contrast, in the embodiment, the support pin 209 is fixed to the first casing 215 and other components. Fixing the support pin 209 eliminates the need for increasing the dimensions of the pump 200, as described above. Also in the embodiment, the fixing grooves 213*b* and 253*b* are respectively formed in the first driven gear 213 and the second driven gear 253. This ensures lubricity in the support pin 209 without using any bearings.

Flow of Oil

Figure 9A:
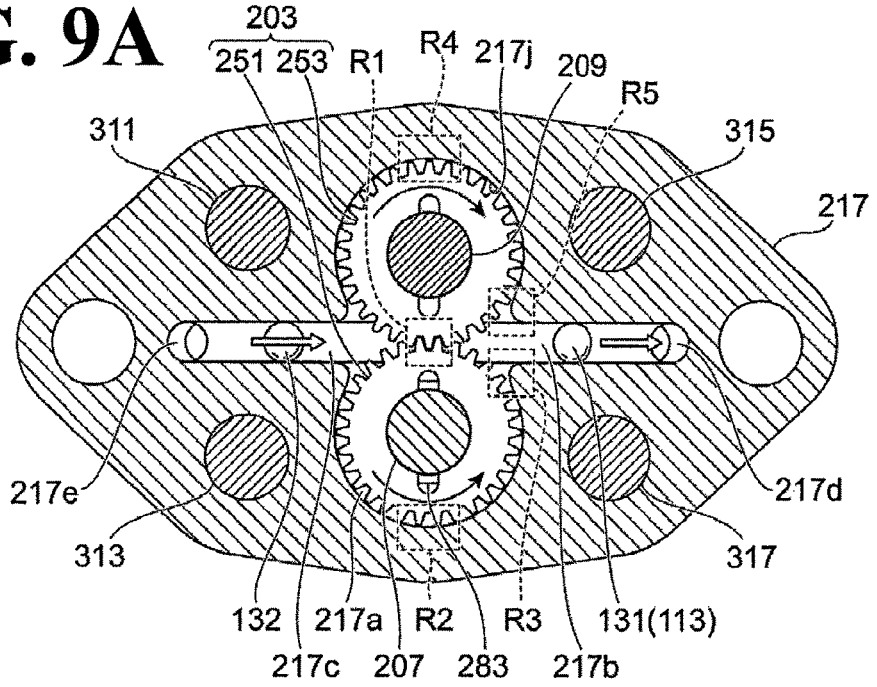
FIGS. 9A and 9B are cross-sectional views of the pump illustrating a flow of oil in the pump.
Figure 9B:
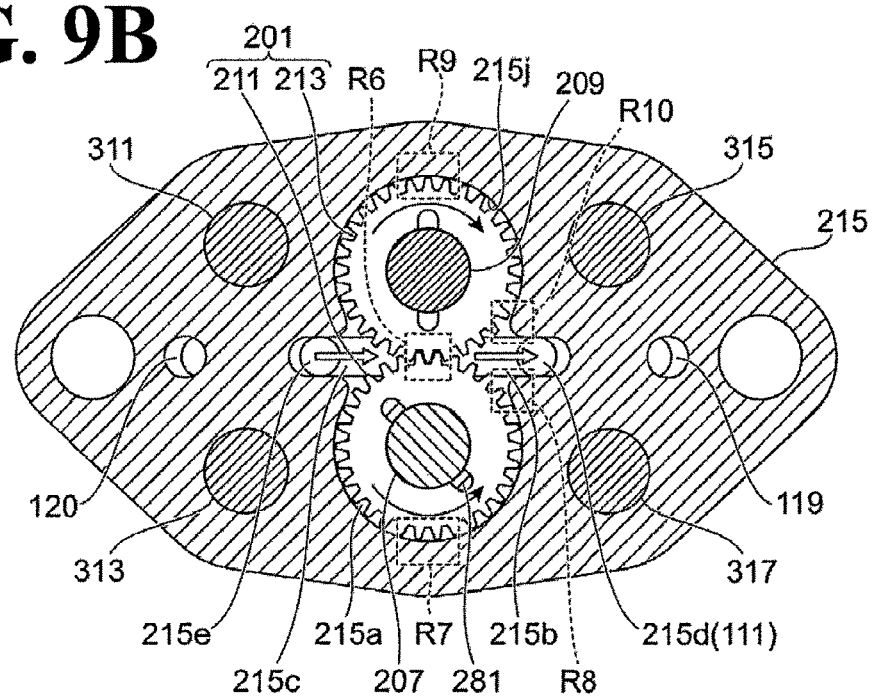

FIGS. 9A and 9B are cross-sectional views of the pump 200 illustrating the flow of oil in the pump 200. Specifically, FIG. 9A illustrates the flow of oil in the second pump 203, and FIG. 9B illustrates the flow of oil in the first pump 201.

Next, the flow of the oil in the pump 200 will be described below by referring to FIGS. 9A and 9B. FIGS. 9A and 9B illustrate a case where the driving shaft 207 rotates anticlockwise in FIGS. 9A and 9B. More specifically, in FIG. 9A, the second driving gear 251 rotates anticlockwise, and the second driven gear 253 rotates clockwise. In FIG. 9B, the first driving gear 211 rotates anticlockwise, and the first driven gear 213 rotates clockwise.

The second pump 203 will be described by referring to FIG. 9A. When the second driving gear 251 and the second driven gear 253 rotate in response to the driving of the driving shaft 207, the oil flows from the second intake passage 122 (see FIG. 4) in a direction (indicated by the outlined arrows in FIG. 9A) toward the third passage 113 through the second pump 203.

Specifically, in the second driving gear 251, the oil flowing from the second intake passage 122 (see FIG. 4) into the second driving gear 251 passes through a confinement region R1, an outer region R2, and a discharge region R3. The confinement region R1 is defined by the engagement between the second driving gear 251 and the second driven gear 253, and confines the oil. The outer region R2 is on the opposite side of the confinement region R1 across the driving shaft 207. The discharge region R3 is where the oil is discharged to a third groove 217*b* (third passage 113). The discharge region R3 is also at a position where the rotation of the second driving gear 251 releases the oil confined between the second driving gear 251 and the inner surface, 217*j*, of the second pump chamber 217*a*.

Similarly, in the second driven gear 253, the oil flowing from the fourth passage 114 (see FIG. 4) into the second driven gear 253 passes through an outer region R4 and a discharge region R5. The outer region R4 is on the opposite side of the confinement region R1 across the support pin 209. The discharge region R5 is where the oil is discharged to the third groove 217*b* (third passage 113). The discharge region R5 is also at a position where the rotation of the second driven gear 253 releases the oil confined between the second driven gear 253 and the inner surface, 217*j*, of the second pump chamber 217*a*.

The oil conveyed by the second driving gear 251 and the second driven gear 253 joins the oil in the third groove 217*b* (third passage 113) in the discharge regions R3 and R5.

Next, the first pump 201 will be described by referring to FIG. 9B. When the first driving gear 211 and the first driven gear 213 rotate in response to the driving of the driving shaft 207, the oil flows from the fourth passage 114 (see FIG. 4) in a direction (indicated by the outlined arrows in FIG. 9B) toward the first passage 111 through the first pump 201.

At the periphery of the first driving gear 211, the oil passes through a confinement region R6, an outer region R7, and a discharge region R8. This configuration is similar to the configuration of the second pump 203 and will not be further elaborated. At the periphery of the first driven gear 213, the oil passes through the confinement region R6, an outer region R9, and a discharge region R10.

The discharge region R8 is at a position where the rotation of the first driving gear 211 releases the oil confined between the first driving gear 211 and the inner surface, 215*j*, of the first pump chamber 215*a*. The discharge region R10 is at a position where the rotation of the first driven gear 213 releases the oil confined between the first driven gear 213 and the inner surface, 215*j*, of the first pump chamber 215*a*.

The oil conveyed by the first driving gear 211 and the first driven gear 213 joins the oil in the first groove 215*b* (first passage 111) in the discharge regions R8 and R10. The oil conveyed by the first driving gear 211 and the first driven gear 213, and the oil conveyed by the second driving gear 251 and the second driven gear 253 joins the oil in the first groove 215*b* (first passage 111). The first passage 111 and the third passage 113 are examples of the passage.

Noises in First Pump 201 and Second Pump 203

Figure 10:
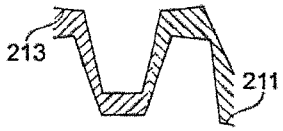
FIG. 10 is a table illustrating a phase of a first pump and a phase of a second pump.
Figure 10:
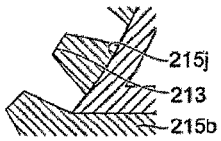
Figure 10:
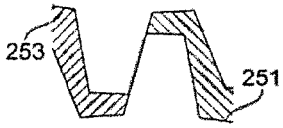
Figure 10:
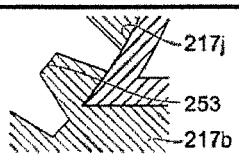

FIG. 10 is a table illustrating a phase of the first pump 201 and a phase of the second pump 203.

Figure 11:
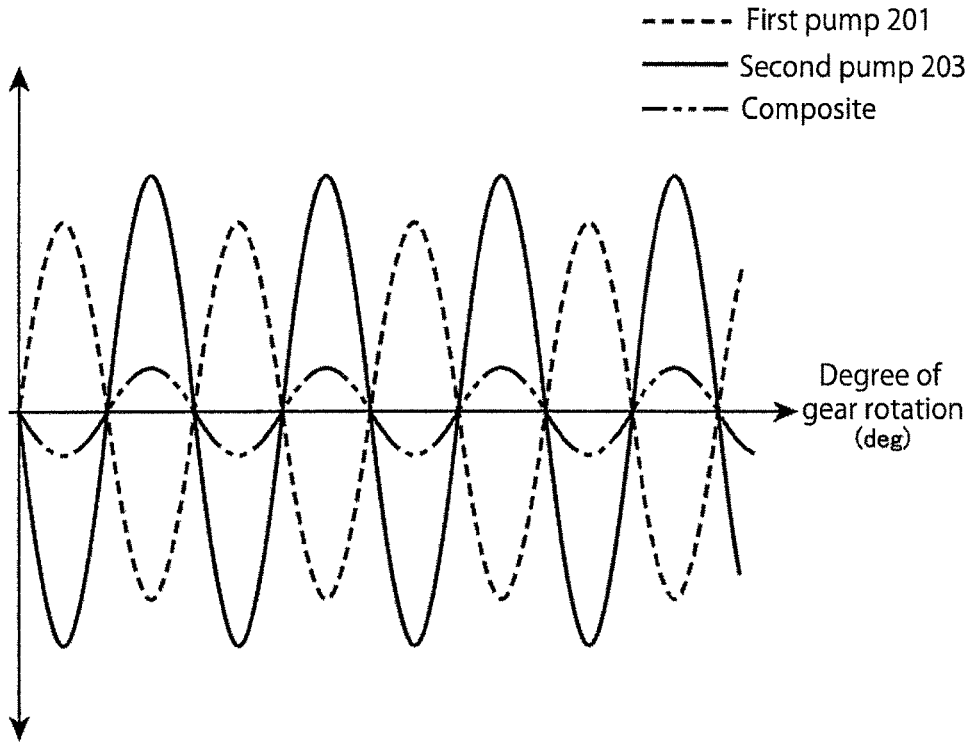
FIG. 11 is a graph illustrating noises generated in the rotation of the first pump and the rotation of the second pump.

FIG. 11 is a graph illustrating noises generated in the rotation of the first pump 201 and the rotation of the second pump 203. In the graph illustrated in FIG. 11, the horizontal axis represents the degrees by which the gears of the first pump 201 and the second pump 203 rotate, and the vertical axis represents the volume of noise generated.

Next, noises are generated in the driving of the first pump 201 and the second pump 203 will be described below by referring to FIGS. 10 and 11.

When the first pump 201 and the second pump 203 are driven, noises occur due to various causes such as a pulsation involved in the discharge of oil, the confinement of oil by engagement of the gears, and the sliding movement of the gears. In particular, as illustrated in FIGS. 10 and 11, where a plurality of pumps (namely, first pump 201 and second pump 203) are used with the common motor 70, the pulsation involved in the discharge of oil may coincide in timing with the confinement of oil. The coincidence in timing may cause the noises to synchronize with each other into a louder noise.

In view of noise considerations, in the embodiment, the first pump 201 and the second pump 203 have phases shifted from each other. In the example illustrated in FIGS. 10 and 11, the first driving gear 211 and the second driving gear 251 have different angles at which the first driving gear 211 and the second driving gear 251 are fixed to the driving shaft 207. This configuration eliminates or minimizes the noises generated in the driving of the first pump 201 and the second pump 203.

More specifically, as illustrated in FIG. 10, in the confinement regions R1 and R6, the first driving gear 211 and first driven gear 213 are engaged with each other at a timing shifted from the timing at which the second driving gear 251 and the second driven gear 253 are engaged with each other. For example, the timing at which the first driving gear 211 and the first driven gear 213 are not engaged with each other in the first pump 201 will be referred to as "open" state timing. At the "open" state timing, the second driving gear 251 and the second driven gear 253 are engaged with each other in the second pump 203, which will be referred to as "closed" state timing.

When the confinement region R6 of the first pump 201 is at the "closed" state timing, the confinement region R1 of the second pump 203 is at the "open" state timing.

In the discharge regions R5 and R10, the confinement state implemented between the first driven gear 213 and the inner surface 215*j* is released at a timing shifted from the timing at which the confinement state implemented between the second driven gear 253 and the inner surface 217*j* is released. That is, the oil fed from the first pump 201 joins the oil in the first groove 215*b* (first passage 111) at a timing shifted from the timing at which the oil fed from the second pump 203 joins the oil in the third groove 217*b* (third passage 113).

For example, as illustrated in FIG. 10, when a confinement state is implemented between the first driven gear 213 and the inner surface 215*j* in the first pump 201, that is, at the "closed" state timing, no confinement state is implemented between the second driven gear 253 and the inner surface 217*j* in the second pump 203, that is, the second pump 203 is at the "open" state timing.

When the confinement region R10 of the first pump 201 is at the "open" state timing, the discharge region R5 of the second pump 203 is at the "closed" state timing, which is not illustrated in FIG. 10.

By referring to FIG. 11, description will be made with regard to noise generated in shifting the phases of the first pump 201 and the second pump 203. In the example illustrated in FIG. 11, the degrees by which the gears of the first pump 201 and the second pump 203 rotate are shifted from each other in phase by half the cycles of the noises generated.

In the configuration illustrated in FIG. 11, where the phases of the first pump 201 and the second pump 203 are shifted from each other, the noises generated in the first pump 201 and the second pump 203 will be compared with a composite noise (indicated by "Noise" in FIG. 11) obtained by combining together the noises generated in the first pump 201 and the second pump 203. The comparison indicates that the composite noise is smaller in maximum noise volume. That is, the comparison indicates that shifting the phases of the first pump 201 and the second pump 203 from each other causes the generated noises to cancel each other, resulting in a reduced composite noise.

Modifications

In the embodiment described above, the first fixing member 281 and the second fixing member 283 are used to shift the position at which the first driving gear 211 is fixed to the driving shaft 207 from the position at which the second driving gear 251 is fixed to the driving shaft 207. This configuration, however, should not be construed in a limiting sense. Any other configuration is possible insofar as the angles of the first driving gear 211 and the second driving gear 251 with respect to the driving shaft 207 are unambiguously determined upon mounting of the first driving gear 211 and the second driving gear 251 to the driving shaft 207. A non-limiting example is to form flat surfaces of mutually different angles with respect to the driving shaft 207 at a plurality of positions on the outer surface of the driving shaft 207.

In the embodiment described above, the first casing 215, the second casing 217, and the third casing 219 make up a three-layer structure, and the support pin 209 is used as a positioning member in the three-layer structure. This configuration, however, should not be construed in a limiting sense. It is also possible to use the support pin 209 as a positioning member in a two-layer structure, a four-layer structure, or a more-than-four-layer structure.

It is also possible to use the support pin 209 as the only positioning member or as one of a plurality of positioning members.

In the embodiment described above, the confinement regions R1 and R6 have open and closed timings shifted from each other, and the discharge regions R5 and R10 have their open and closed timings shifted from each other. Another possible embodiment is to implement a shift in the open and closed timings only in the confinement regions R1 and R6 or in the discharge regions R5 and R10. Another possible embodiment is to synchronize the open and closed timings of the confinement regions R1 and R6 with the open and closed timings of the discharge regions R5 and R10, or shift the open and closed timings of the confinement regions R1 and R6 from the open and closed timings of the discharge regions R5 and R10.

A pump apparatus may include a plurality of pumps in the pump apparatus. This configuration may cause the entirety of the pump apparatus to generate large noise since noises generated by the pumps synchronize with one another.

In a non-limiting embodiment, the first driving gear may be disposed on the shaft at a first angle, and the second driving gear may be disposed on the shaft at a second angle different from the first angle.

In a non-limiting embodiment, the first driving gear and the second driving gear may have equal numbers of teeth.

In a non-limiting embodiment, the first teeth, the second teeth, the third teeth, and the fourth teeth may have equal numbers of teeth.

The embodiments eliminate or minimize noise generated in the driving of a pump apparatus including a plurality of pumps can be reduced.

Obviously, numerous modifications and variations of the present invention are possible in light of the above teachings. It is therefore to be understood that within the scope of the appended claims, the present invention may be practiced otherwise than as specifically described herein.

What is claimed is:

1. A pump apparatus comprising:

a shaft;

a first pump comprising a first driving gear which is disposed on the shaft in a first phase of gear rotation and is rotatable with the shaft to feed a first operating fluid; and a second pump comprising a second driving gear disposed on the shaft in a second phase of gear rotation, the second driving gear being coaxial with the first driving gear and rotatable with the shaft to feed a second operating fluid, wherein the second phase is shifted from the first phase in a degree of gear rotation.

2. The pump apparatus according to claim 1, wherein the first driving gear is disposed on the shaft at a first angle, and wherein the second driving gear is disposed on the shaft at a second angle different from the first angle.

3. The pump apparatus according to claim 1, wherein the first driving gear and the second driving gear have equal numbers of teeth.

4. A pump apparatus comprising:

a shaft;

a first pump comprising a first pair of gears, the first pair of gears comprising:

a first driving gear disposed on the shaft and being rotatable with the shaft and comprising first teeth; and a first driven gear engaged with the first driving gear to be driven by the first driving gear so as to feed a first operating fluid, the first driven gear comprising second teeth engageable with the first teeth at a first timing when the shaft rotates; and a second pump comprising a second pair of gears, the second pair of gears comprising:

a second driving gear disposed on the shaft and being coaxial with the first driving gear and rotatable with the shaft and comprising third teeth; and a second driven gear engaged with the second driving gear to be driven by the second driving gear so as to feed a second operating fluid, the second driven gear comprising fourth teeth engageable with the third teeth at a second timing different from the first timing when the shaft rotates.

5. The pump apparatus according to claim 4, wherein the first teeth, the second teeth, the third teeth, and the fourth teeth have equal numbers of teeth.

6. A vessel propelling machine comprising:

a marine-vessel-propelling-machine body comprising a propeller; and a tilt-and-trim apparatus comprising:

a cylinder apparatus comprising:

a cylinder;

a piston which partitions an inside of the cylinder into a first chamber and a second chamber; and a piston rod having an end fixed to the piston and extending from the cylinder; and a pump apparatus configured to supply an operating fluid into an inside of the cylinder apparatus so as to extend and retract the cylinder apparatus, the pump apparatus comprising:

a shaft;

a first pump comprising a first pair of gears, the first pair of gears comprising:

a first driving gear disposed on the shaft and rotatable with the shaft; and a first driven gear driven by the first driving gear so as to feed a first operating fluid;

a second pump comprising a second pair of gears, the second pair of gears comprising:

a second driving gear disposed on the shaft and being coaxial with the first driving gear and rotatable with the shaft; and a second driven gear engaged with the second driving gear to be driven by the second driving gear so as to feed a second operating fluid; and a passage into which the first operating fluid flows at a first timing and into which the second operating fluid flows at a second timing shifted from the first timing.

7. The pump apparatus according to claim 2, wherein the first driving gear and the second driving gear have equal numbers of teeth.

* * * * *